United States Patent [19]

Smeets et al.

[11] Patent Number: 5,026,770

[45] Date of Patent: Jun. 25, 1991

[54] RESIN COMPOSITION AND PROCESS FOR PREPARING THIS RESIN COMPOSITION

[75] Inventors: Paulus J. H. M. Smeets, Meerssen; Caspar G. M. Paas, Heerlen; Willem P. M. Kraanen, Sittard, all of Netherlands

[73] Assignee: Stamicarbon B.V., Geleen, Netherlands

[21] Appl. No.: 460,559

[22] Filed: Jan. 3, 1990

[30] Foreign Application Priority Data

Jan. 4, 1989 [NL] Netherlands ..... 8900009

[51] Int. Cl.[5] ..... C08L 67/08

[52] U.S. Cl. ..... 525/7.1; 525/44; 525/48; 525/7.4

[58] Field of Search ..... 525/7.4, 7.1, 44, 48

[56] References Cited

FOREIGN PATENT DOCUMENTS 0228116 7/1987 European Pat. Off. .

3301729 7/1984 Fed. Rep. of Germany .

*Primary Examiner*—Patricia Short

*Attorney, Agent, or Firm*—Cushman, Darby & Cushman

[57] ABSTRACT

The invention relates to a resin composition comprising a mixture of resins, a first resin of which consists of the reaction product of an epoxidized fatty acid ester of a polyvalent alcohol with a carboxylic acid and a second resin consists of an ester of a polyvalent alcohol, modified with carboxylic acid.

The resin mixture, contains an unsaturated polyester resin having a molecular weight of 1200–20,000 per double bond and an acid number of 5–50, from about 50% to about 90% of the unsaturation being formed by a semi-ester of an $\alpha,\beta$-unsaturated dicarboxylic acid.

8 Claims, No Drawings

RESIN COMPOSITION AND PROCESS FOR PREPARING THIS RESIN COMPOSITION

FIELD OF THE INVENTION

The invention relates to a resin composition comprising a mixture of resins, a first resin which consists of the reaction product of an epoxidized fatty acid ester of a polyvalent alcohol with a carboxylic acid and a second resin which consists of an ester of a polyvalent alcohol, modified with a carboxylic acid, and also to a process for preparing such a resin composition.

BACKGROUND INFORMATION

In many processes used for preparing a resin composition for the preparation of linoleum (the resin composition hereinafter will be referred to as linoleum cement; also referred to as Bedford cement in the linoleum preparation industry, after the manner of formation) make use of one or more polyunsaturated oils are started from, which oils are first 'dried' by air oxidation. These drying oils are mixed, with a resin, is particular with colophony, before or during or after the drying, which will then produce the Bedford cement. After mixing this cement with fillers and pigments, the resulting linoleum mix is usually applied to a mostly jute substrate using a calender and the product obtained is then cured for a number of weeks at 60°-80° C. (see, inter alia, Ullmann, Encyklopädie der technischen Chemie, Band 12 (1976), p. 24 ff. and Encycl. of Pol. Sci. and Techn. Vol. 1 (1964) p. 403 ff.).

The disadvantage associated with this process for the preparation of linoleum is the long period of time required for curing or maturing the product, which in turn depends on the thickness of the linoleum layer. Further, in order to determine if the desired hardness has been reached, an intensive, manual inspection is required.

European patent application 174042, describes a resin composition suitable for a linoleum cement, with a substantial reduction in the period of time required for the hardening of the linoleum and with an improvement in the homogeneity of the material thus obtained.

The resin composition comprises a mixture of resins, the first resin which consists of the reaction product of an epoxidized fatty acid ester of a polyvalent alcohol with a monovalent carboxylic acid, while the second resin consists of an ester of a polyvalent alcohol, modified with carboxylic acid. The phrase 'modified with carboxylic acid' in this connection also comprises the presence of carboxylic anhydride groups in place of or in addition to carboxylic acid groups.

However, a problem associated with this resin composition is that, in the absence of linoleum cement, the products based on this composition are too brittle.

SUMMARY OF THE INVENTION

An object of the invention is to provide a resin composition which does not have the above mentioned disadvantages.

It is another object of the invention to provide a process for preparing such a resin composition.

According to one embodiment the resin composition according to the invention, comprises a mixture of resins a first resin which consists of the reaction product of an epoxidized fatty acid ester of a polyvalent alcohol with a carboxylic acid and a second resin which consists of an ester of a polyvalent alcohol, modified with carboxylic acid, is characterized in that the mixture of resins also comprises an unsaturated polyester resin with a molecular weight of 1200-20,000 per double bond and an acid number of 5-50, from about 50% to about 90% of the unsaturation being formed by a semi-ester of an $\alpha,\beta$-unsaturated dicarboxylic acid.

The unsaturation can be terminal and random. Preferably the unsaturation is terminal.

According to another embodiment, the invention is directed to a process for preparing a resin composition wherein a first resin, a second resin and optionally linoleum cement are mixed at temperature ranges from about 30° C. to about 90° C. in the presence of an initiator system selected from the group of peroxides, perketals and percarbonates.

DETAILED DESCRIPTION OF THE INVENTION

As noted above, the invention relates to a resin composition comprising a mixture of resins, a first resin which consists of the reaction product of an epoxidized fatty acid ester of a polyvalent alcohol with a carboxylic acid and a second resin which consists of a polyvalent alcohol, modified with carboxylic acid, wherein the resin mixture also contains an unsaturated polyester resin with a molecular weigh of 1200-20,000 per double bond and an acid number of 5-50, from about 50% to about 90% of the unsaturated being formed by a semi-ester of an $\alpha,\beta$-unsaturated dicarboxylic acid.

The unsaturated polyester resin is synthesized from organic compounds containing carboxyl and alcohol groups. For the preparation of polyesters it is customary to use carboxylic diacids and dialcohols, but up to 40% (wt) of the two types of difunctional monomers can be replaced by polyfunctional monomers or monofunctional monomers or mixtures thereof preferably less than 20% (wt) of the two types of difunctional monomers is replaced by a polyfunctional monomer. More particularly 3-10% (wt) of one of the two types of difunctional monomers is replaced by a trifunctional monomer in order to obtain a branched unsaturated polyester. A higher molecular weight structure will be obtained more rapidly.

The acids that can be used normally contain fewer than 30 carbon atoms, preferably fewer than 20, most preferably than 10 carbon atoms.

The ethylenically unsaturated dicarboxylic acid applied is preferably an $\alpha,\beta$-ethylenically unsaturated dicarboxylic acid, for example a dicarboxylic acid selected from fumaric acid, maleic acid, chloromaleic acid, itaconic acid, mesaconic acid, citraconic acid or the corresponding esters or anhydrides.

An ethylenically unsaturated mono or tricarboxylic acid can be selected from, for example, the group of linoleic acid, or the other unsaturated fatty acids, cinnamic acid, atropic acid, acrylic acid, methacrylic acid, ethacrylic acid, propacrylic acid, crotonic acid, isocrotonic acid, or corresponding ester or anhydride derivatives.

Other dicarboxylic acids are preferably saturated and aliphatic or saturated and aromatic. Aliphatic and aromatic dicarboxylic acids are selected from succinic acid, glutaric acid, methylglutaric acid, adipic acid, sebacic acid, pimelic acid, phthalic acid, isophthalic acid, terephthalic acid, dihydrophthalic acid, tetrahydrophthalic acid, tetrachlorophthalic acid, 3,6-endomethylene-1,2,3,6-tetrahydrophthalic acid and hexachloroendomethylenetetra-hydro-phthalic acid or the corresponding ester- or anhydride derivatives.

Mono and/or polyfunctional aromatic or aliphatic carboxylic acids are selected from benzoic acid, ethylhexanoic acid, mono or trimeric fatty acids, such as stearic acid, acetic acid, propionic acid, pivalic acid, valeric acid, trimellitic acid, 1,2,3,4-butanetetracarboxylic acid, 1,2,4,5-benzene-tetracarboxylic acid, 1,4,5,8-naphthalenetetracarboxylic acid, 1,2,3-propanetricarboxylic acid, 1,2,3-tricarboxylic acid butane, camphoric acid, naphthoic acid, toluic acid, or the corresponding ester or anhydride derivatives.

The alcohols that can be used normally contain fewer than 30 carbon atoms, preferably fewer than 20 carbon atoms, although particularly in ethoxylated or propoxylated bisphenol-A derivatives or in polyethylene glycol and polypropylene glycol greater numbers of carbon atoms may occur. Preference is given to the use of saturated aliphatic alcohols or of alcohols containing an aromatic group. However ethylenically unsaturated alcohols can also be used. Dialcohols are selected from the group: ethylene glycol, di(ethyleneglycol), tri(ethyleneglycol), 1,2-propane diol, dipropylene glycol, 1,3-propane diol, 1,2-butane diol, 1,3-butane diol, 1,4-butane diol, 2-methyl-1,3-propane diol, 1,4-pentane diol, 1,4-hexane diol, 1,6-hexane diol, 2,2-dimethylpropane diol, cyclohexane diol, 2,2-bis-(hydroxycyclo-hexyl)-propane, 1,2-trimethylolpropanemonoallyl ether, pinacol, 2,2,4-trimethylpentanediol-1,3,3-methylpentanediol-1,5, with 1–20 equivalents of ethoxylated or propoxylated bisphenol-A and novolak prepolymers, optionally partially etherified and ethoxylated. Alternatively instead of a 1,2-diol, the corresponding oxirane compound can be used.

Mono and polyfunctional alcohols are selected from methanol, ethanol, 1- or 2-propanol, 1 or 2-butanol, one of the isomers of pentanol, hexanol, octanol, 2-ethyl hexanol, fatty alcohols, benzyl alcohols, 1,2-di(allyloxy)-3-propanol, glycerol, 1,2,3-propane triol, pentaerythritol, tris(hydroxyethyl)isocyanurate and novolak prepolymers, optionally partially etherified and ethoxylated.

The ethylenically unsaturated alcohols which can be used are particularly alkoxylated unsaturated acids including 2-hydroxyethyl(meth)acrylate, 2-hydroxypropyl(meth)acrylate, bis-(2-hydroxyethyl)fumarate, but also, for instance, butene diol.

It may be advantageous to use an unsaturated polyester modified with dicyclopentadienyl (DCPD) units.

The polyester resins can be prepared in many ways, for example by melt condensation, solvent condensation, in which water is removed by distillation, whether or not in an azeotropic mixture, by epoxy-acid reactions and by other techniques known to the person skilled in the art.

The unsaturated polyester resin may contain up to 70% (wt) of a compound containing one or more vinyl groups.

The compound containing one or more vinyl groups normally contains fewer than 50 carbon atoms, preferably fewer than 30, and most preferably fewer than 15, but more than 3 carbon atoms. The compound containing one or more vinyl groups is preferably of the vinylaromatic, vinyl ether, vinyl ester, acrylate and/or allyl type. More particularly a vinylaromatic or acrylate compound is used, because these compounds react quickly during the radical polymerization and preference is given to the use of a vinylaromatic compound. Vinylaromatic compounds are selected from styrene, α-methylstyrene, o-, m-,p-methylstyrene, p-chlorostyrene, t-butylstyrene, divinylbenzene, bromostyrene, vinylnaphthalene, α-chlorostyrene and divinylnaphthalene.

The unsaturated polyester preferably has a molecular weight from about 500 to about 5000, particularly from 1000–4000. The acid number is between 5–50 and the hydroxyl number between 0–50.

The acid and hydroxyl numbers are defined as mg KOH per gram polymer, according to ASTM D 1936-70 and ASTM E 222-73 respectively.

The unsaturated polyester resin is prepared preferably in two steps, in a first step an excess of the glycol component is esterified with a dicarboxylic acid component and in a second step esterified quickly with 1,2-alkenedicarboxylic acid, in which process 1–12 moles % of the unsaturated dicarboxylic acid component of the first step consists of or is isomerized to form trans-1,2-alkenedicarboxylic acid and in the second step esterification takes place with alkenedicarboxylic acid or with a derivative thereof, in which step the chosen amount of the acid or derivative is such that it makes up to 1–30 moles % of the total amount of dicarboxylic acid. The first step is usually carried out at a reaction temperature of 190°–220° C. with an acid number of about 10 and an OH number of 15–60, upon which in a second step at a temperature of 110°–170° C. a further reaction with 1,2-alkenedicarboxylic anhydride takes place in 0.5–4 hours. At this lower reaction temperature isomerization reactions are avoided and transesterification reactions are suppressed. It is efficient if this esterification is to be carried out in an inert atmosphere and to remove the reaction water, for instance by azeotropic distillation. After the unsaturated polyester has been obtained, it is cooled and can be diluted with up to 70% (wt), preferably 15–50% (wt), of one or more vinylcompounds as described hereinbefore.

According to a preferred embodiment, the resin composition contains

5–50 parts by weight of the first resin,
5–70 parts by weight of the second resin and
1–80 parts by weight of the unsaturated polyester resin.

According to a further preferred embodiment, the resin composition contains

30–40 parts by weight first resin,
45–55 parts by weight second resin and
10–20 parts by weight of the unsaturated polyester resin.

The present invention also provides a process for preparing a resin composition by mixing the first resin and the second resin, or of the first resin, second resin and unsaturated polyester resin, for such a period of time and at such a temperature that a partial pre-reaction takes place. This partially pre-reacted condition is referred to as the "B-stage". The dynamic viscosity ($\mu_d$) may range between $10^2$ and $10^3$ Pas giving the resin composition the consistency needed to yield an excellent product upon further processing to linoleum.

To obtain the partially pre-reacted condition the resins are mixed during 5 min–4 hours at a temperature between 60° C. and 250° C.

Preferably the temperature is between 120° C. and 180° C. and the time period for mixing ranges between 0,5 hours to 2,5 hours.

The "B-stage" can be processed to a surface-covering layer by adding the usual fillers and pigments and a catalysator. An unsaturated polyester resin and/or linoleum cement can also be added, when these are not present in the "B-stage", before turning to further processing.

This "B-stage" is already described in European patent application 228116, wherein a resin composition is described comprising a mixture of at least two resins, one resin consisting of the reaction product of an epoxidized fatty acid ester of a polyvalent alcohol with a carboxylic acid modified ester of a polyvalent alcohol and wherein the first and second resins have been mixed for a sufficient time and at a temperature such that a partial pre-reaction takes place.

The disadvantage of this resin composition is that products based on this composition are too brittle.

When linoleumcement is present, the resin composition may contain up to 95% (wt) of the linoleumcement, preference is given to 50–90 % (wt) based on the total resin composition.

The resin composition can be obtained by mixing the first resin, the second resin, the unsaturated polyester resin and optionally linoleum cement on a two-roll calender at temperatures of from about 30° C. to about 90° C. in the presence of an initiator system selected from peroxides, perketals and percarbonates. Examples include hydrogen peroxide, benzoyl peroxide, t-butyl peroxide, t-butyl peroctoate, t-butyl perbenzoate, dicumyl peroxide, di-t-butyl peroxide, trimethyl-cyclohexanone perketal, methylethylketone peroxide, acetylacetone peroxide, cyclohexanone peroxide, methylisobutylketone peroxide and diacetone alcohol peroxide.

Further, catalysts can be added, such as octoates or naphthanates of copper, lead, calcium, magnesium, cerium and particularly of manganese and cobalt, or vanadium complexes. To these accelerators can be added promotors such as, for example, acetylacetone. The catalysts used may also be aromatic amines, such as dimethylaniline, diethylaniline or dimethylpara-toluidine.

Raw materials can be added such as for example, wood flour, cork dust, pigments and fillers.

The radical reaction between the various components can take place in 1–20 minutes at 100°–150° C. and subsequently in 4–250 hours at 70°–90° C.

The first and the second resin are preferably prepared with the use of modified, drying oils. The drying oil in the first resin is used in epoxidized form, using particularly an epoxide of soybean oil, linseed oil, sunflower oil and/or a tall oil fatty acid ester. The polyvalent alcohol with which the esterification has been carried out is preferably selected from glycerol, pentaerythritol, trimethylol propane and/or polyalkene glycol. Mixtures of these or other polyvalent alcohols can also be used.

The carboxylic acid to be used in the first resin may, for example, be a monovalent carboxylic acid, such as benzoic acid, para-tertiary-butyl-benzoic acid, tall oil fatty acid or stearic acid, divalent or polyvalent carboxylic acids, colophony, acid hydrocarbon resins and/or mixtures thereof. For the preparation of linoleum, preference is given to the use of colophony as acid so as to retain the properties characteristic of linoleum, which properties the linoleum owes to the colophony. Suitable polyvalent carboxylic acids are carboxylic acids with 4–54 C atoms in the molecule. The polyvalent carboxylic acid used may particularly be a dimeric or trimeric fatty acid, or a mixture thereof.

The ester in the second resin, modified with carboxylic acid, may consist of the reaction product of an unsaturated fatty acid ester of a polyvalent alcohol with one or more ethylenically unsaturated mono or polyvalent carboxylic acids or the anhydrides thereof. The unsaturated fatty acid ester may be a vegetable oil or a tall oil fatty acid ester, the esterification being effected particularly with a polyvalent alcohol from the group of glycerol, pentaerythritol, trimethylol propane and/or polyalkene glycol, in which process mixtures of these or of other polyvalent alcohols can also be used. The vegetable oils suitable for use in connection with this invention are particularly soybean oil, linseed oil, sunflower oil, olive oil, safflower oil and/or rapeseed oil.

The ethylenically unsaturated carboxylic acid or the anhydride thereof, which is used for the preparation of the second resin, may contain one or more ethylenically unsaturated groups in the molecule. The monovalent carboxylic acid that can be used is preferably acrylic acid, methacrylic acid, sorbic acid and/or crotonic acid. The polyvalent carboxylic acid that can be used is preferably maleic acid and/or fumaric acid and/or the anhydrides thereof. Maleic anhydride is particularly suited for it, because the maleinated oils can be prepared readily and are commercially available.

The ester in the second resin, modified with carboxylic acid, may also consist of the reaction product of a hydroxy-functional fatty acid ester of a polyvalent alcohol with a polyvalent carboxylic acid. For this purpose can be used particularly the esters derived from castor oil, hydroxystearic acid and/or hydroxypalmitic acid. The polyvalent alcohol selected for the esterification is preferably glycerol, pentaerythritol, trimethylol propane and/or polyalkene glycol. Mixtures of these or of other polyvalent alcohols can be used also. The polyvalent carboxylic acid that is reacted with the said hydroxy-functional fatty acid ester can preferably be taken from the group of phthalic acid, tetra- or hexahydrophthalic acid and trimellitic acid.

The second resin, may also consist of one or more acid-functional alkyd resins and/or acid-functional hydrocarbon resins and/or mixtures hereof.

The first resin can be prepared by reacting the epoxydized ester with the carboxylic acid. This process is carried out at a temperature of 100° to 250° C. and preferably 150° to 200° C., optionally in the presence of a catalyst. The catalyst used is preferably the catalyst customarily used for the acid-epoxy reaction for example, triethylamine.

When reacting the first and the second resin, a catalyst may be added of the same type as used in the preparation of the first resin.

The resin composition according to the invention can also be used in combination with resin compositions based on one or more polyunsaturated oils, which are 'dried' by oxidation in the presence of air.

Although the use of the resin composition according to the invention has been referred to in connection with the preparation of linoleum, the use of said resin composition is not limited thereto. Other systems using resin compositions, in the form of two-component resins, for the purpose of obtaining a surface layer are also suited for the use of these resin compositions. In this connection application in roofing material and Unterbodenschutz in the automotive industry may also be thought of.

The invention is elucidated by means of the following nonrestrictive examples.

EXAMPLES

Example I

Preparation of the first resin

Into a 3-l reaction vessel provided with a mechanical stirrer, thermometer and a vertical condenser 60 parts (wt) epoxidized linseed oil (Edenol B 316 from Henkel, oxirane content higher than 8.5%), 40 parts (wt) colophony and 1 part (wt) triisobutylamine are introduced. While nitrogen is being passed over it, the reaction mixture is heated to 180° C. The contents of the reaction vessel are kept at this temperature until the acid number has fallen to 3 mg KOH/g. The product is then cooled. The epoxy equivalent weight is 600.

Example II

Preparation of the second resin

In equipment similar to that used for the preparation of the first resin 878 parts (wt) linseed oil is heated in a nitrogen atmosphere to 200° C. Subsequently, 294 parts (wt) maleic anhydride is added carefully in portions divided over two hours. Care is taken not to allow the temperature to rise higher than 200° C. After everything has been added, the temperature is gradually brought to 225° C. and maintained for 4 hours.

Example III

Preparation of unsaturated polyester resin

A reaction vessel provided with stirrer, thermometer, vigreux column, condenser and nitrogen feed was filled at room temperature with 9.0 moles adipic acid, 0.3 mole fumaric acid and 9.4 moles neopentyl glycol. While water was being distilled off, this mixture was subsequently heated until a temperature of 210° C. was reached. The reaction was continued until the acid number of the product was 5–10. The polyester was subsequently cooled to a temperature of 150° C. At that moment 0.7 mole maleic anhydride was added. After a reaction period of 2 hours, at a temperature of 150° C., the mixture was cooled to 100° C. The acid number of the resulting polyester resin was 15.

Examples I–II and Comparative Examples A–B

The resin according to Example I, the resin according to Example II, the unsaturated polyester according to Example III and linoleum cement were mixed as indicated in Table 1. To the compositions containing the unsaturated polyester was added 4% (wt) tert.-butylperbenzoate (calculated on the total composition).

TABLE 1

| Composition | FIRST resin % (wt) | SECOND resin % (wt) | unsaturated polyester % (wt) | linoleum cement % (wt) |
|---|---|---|---|---|
| A | — | — | — | 100 |
| B | 41.1 | 58.9 | — | — |
| I | 8.6 | 11.4 | 15 | 65 |
| II | 36.6 | 48.4 | 15 | — |

128 grams resin composition according to Table 1, 140 grams wood flour, 80 grams cork dust and 52 grams calcium carbonate were mixed for 12 hours on a Collin two-roll mill (temperature before: 40° C.; after: 80° C.). The compounded rolled sheets were cured in an oven with air ventilation.

First the sheets were cured for 10 minutes at 125° C. and subsequently the sheets were cured for respectively 4, 8, 132, 280, 480 and 672 hours at 80° C.

During the curing cycle, the E-modulus, tensile strength and elongation at break were determined according to ISO R-527-2.

TABLE 2

| | E-modulus (GPa) number of hours at 80° C. | | | | | |
|---|---|---|---|---|---|---|
| Mixture | 4 | 8 | 132 | 280 | 470 | 672 |
| A | 14.5 | 17.4 | 27.9 | 35.9 | 44.6 | 54.4 |
| B | 12.0 | 19.0 | 230.0 | 530.0 | ** | ** |
| I | 20.7 | 34.0 | 47.1 | 56.4 | 62.5 | 73.8 |
| II | 26.9 | 60.9 | 99.4 | 133.6 | 226 | 618 |

**too brittle

TABLE 3

| | Tensile strength (GPa) number of hours at 80° C. | | | | | |
|---|---|---|---|---|---|---|
| Mixture | 4 | 8 | 132 | 280 | 470 | 672 |
| A | 0.46 | 0.62 | 1.11 | 1.48 | 1.63 | 2.40 |
| B | 0.41 | 1.12 | 5.72 | 6.94 | ** | ** |
| I | 0.57 | 1.09 | 1.80 | 2.18 | 2.58 | 3.01 |
| II | 0.95 | 2.80 | 4.82 | 5.48 | 6.61 | 10.15 |

**too brittle

TABLE 4

| | Elongation at break (%) number of hours at 80° C. | | | | | |
|---|---|---|---|---|---|---|
| Mixture | 4 | 8 | 132 | 280 | 470 | 672 |
| A | 5.6 | 5.3 | 5.9 | 5.2 | 4.4 | 5.4 |
| B | 4.5 | 4.6 | 5.7 | 3.8 | ** | ** |
| I | 4.0 | 4.4 | 5.0 | 4.6 | 4.8 | 4.9 |
| II | 5.1 | 5.7 | 6.1 | 5.5 | 6.4 | 2.9 |

**too brittle

These figures show, for instance, that, after 8 hours at 80° C., the E-modulus, tensile strength and elongation at break of mixture II are virtually the same as those of mixture A after 672 hours at 80° C.

The E-modulus, tensile strength and elongation at break of mixture II were substantially higher than those of mixture A and the curing time was shorter.

We claim:

1. A resin composition comprising a mixture of resins, a first resin which consists of the reaction product of an expoxidized fatty acid ester of a polyvalent alcohol with a carboxylic acid and a second resin which consists of an ester of a polyvalent alcohol, modified with carboxylic acid, wherein the resin mixture also contains an unsaturated polyester resin with a molecular weight of 1200–20,000 per double bond and an acid number of 5–50, from about 50% to about 90% of the unsaturation being formed by a semi-ester of an $\alpha,\beta$-unsaturated dicarboxylic acid.

2. Resin composition according to claim 1, wherein the resin composition contains:

5–50 parts by weight first resin,

5–70 parts by weight second resin and

1–80 parts by weight unsaturated polyester resin.

3. Resin composition according to claim 2, wherein the resin composition contains:

30–40 parts by weight first resin,

45–55 parts by weight second resin and

10–20 parts by weight unsaturated polyester resin.

4. Resin composition according to claim 1, wherein the resin composition contains linoleum cement.

5. Process for preparing a resin composition comprising a mixture of resins, wherein a first resin which consists of the reaction product of an epoxidized fatty acid ester of a polyvalent alcohol with a carboxylic acid, a second resin which consists of an ester of a polyvalent alcohol, modified with carboxylic acid, and an unsaturated polyester resin with a molecular weight of 1200–20,000 per double bond and an acid number of 5–50, from about 50% to about 90% of the unsaturation being formed by a semi-ester of an $\alpha,\beta$-unsaturated dicarboxylic acid, and optionally linoleum cement are mixed at temperatures of from about 30° C. to about 90° C. in the presence of an initiator system selected from peroxides, perketals and percarbonates.

6. Surface layer prepared with a resin composition comprising a mixture of resins, a first resin which consists of the reaction product of an epoxidized fatty acid ester of a polyvalent alcohol with a carboxylic acid and a second resin which consists of an ester of a polyvalent alcohol, modified with carboxylic acid, wherein the resin mixture also contains an unsaturated polyester resin with a molecular weight of 1200–20,000 per double bond and an acid number of 5–50, from about 50% to about 90% of the unsaturation being formed by a semi-ester of an $\alpha,\beta$-unsaturated dicarboxylic acid.

7. Linoleum prepared with a resin composition comprising a mixture of resins, a first resin which consists of the reaction product of an epoxidized fatty acid ester of a polyvalent alcohol with a carboxylic acid and a second resin which consists of an ester of a polyvalent alcohol, modified with carboxylic acid, wherein the resin mixture also contains an unsaturated polyester resin with a molecular weight of 1200–20,000 per double bond and an acid number of 5–50, from about 50% to about 90% of the unsaturation being formed by a semi-ester of a $\alpha,\beta$-unsaturated dicarboxylic acid.

8. Article wholly or partly produced with a resin composition comprising a mixture of resins, a first resin which consists of the reaction product of an epoxidized fatty acid ester of a polyvalent alcohol with a carboxylic acid and a second resin which consists of an ester of a polyvalent alcohol, modified with carboxylic acid, wherein the resin mixture also contains an unsaturated polyester resin with a molecular weight of 1200–20,000 per double bond and an acid number of 5–50, from about 50% to about 90% of the unsaturation being formed by a semi-ester of an $\alpha,\beta$-unsaturated dicarboxylic acid.

* * * * *